US006835050B2

(12) United States Patent
Na et al.

(10) Patent No.: US 6,835,050 B2
(45) Date of Patent: Dec. 28, 2004

(54) RECIPROCATING COMPRESSOR

(75) Inventors: Jong-young Na, Gwangju (KR); Yong-yeoun Kim, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 23 days.

(21) Appl. No.: 10/368,522

(22) Filed: Feb. 18, 2003

(65) Prior Publication Data

US 2004/0013550 A1 Jan. 22, 2004

(30) Foreign Application Priority Data

Jul. 19, 2002 (KR) ..... 2002-42676

(51) Int. Cl.[7] ..... F04B 39/00
(52) U.S. Cl. ..... 417/312; 417/540
(58) Field of Search ..... 417/540, 312, 417/313, 415, 902; 181/403, 236, 212

(56) References Cited

U.S. PATENT DOCUMENTS 2,236,112 A * 3/1941 Philipp ..... 92/78
5,173,034 A * 12/1992 Riffe ..... 417/312
5,577,901 A * 11/1996 Yoon ..... 417/571
5,749,714 A * 5/1998 Lee ..... 417/312
6,533,064 B1 * 3/2003 Kim et al. ..... 181/250

* cited by examiner

*Primary Examiner*—Charles G. Freay
(74) *Attorney, Agent, or Firm*—Ladas & Parry LLP

(57) ABSTRACT

A reciprocating compressor comprising a main frame disposed inside a case to support an electrically-driven unit, a cylinder block connected with the main frame 100 and having a compression chamber, a cylinder head having a refrigerant discharge chamber and connected with the cylinder block to seal the compression chamber, a first chamber formed at one side of the cylinder block to be connected with the refrigerant discharge chamber, a second chamber connected with a refrigerant discharge pipe being formed at other side of the cylinder block, and a gasket disposed between the main frame and the cylinder block having a groove forming a connecting path connecting the first chamber and the second chamber. Discharge pulsation is reduced as the compressed refrigerant flows to the first chamber, the connecting path, and the second chamber before being discharged through the refrigerant discharge pipe.

8 Claims, 4 Drawing Sheets

RECIPROCATING COMPRESSOR

BACKGROUND OF THE INVENTION

1. Field of the Invention

The present invention relates generally to a reciprocating compressor, and more particularly, to a reciprocating compressor having a discharge pulsation reducing structure for reducing noise made during the discharge of refrigerant step.

2. Description of the Related Art

A general reciprocating compressor is used in refrigerating machines, such as refrigerators and water cooling machines, for compressing low pressure gas refrigerant into high pressure refrigerant.

As shown in FIG. 1, a conventional reciprocating compressor comprises a case 10 comprised of an upper shell 11 and a lower shell 12, a compression unit 30 disposed inside the lower part of the compressor and comprised of apparatuses for compressing refrigerant, and an electrically-driven unit 20 for driving the compression unit 30.

The compression unit 30 comprises a cylinder head 60 having a refrigerant suction chamber 61 and a refrigerant discharge chamber 62, a cylinder block 70 having a compression chamber 71 in which refrigerant is compressed, a valve assembly 80 controlling the flow of refrigerant between the cylinder head 60 and the cylinder block 70, a piston 50 disposed inside the compression chamber 71, and a connecting rod 40 moving the piston 50 to reciprocate linearly.

The electrically-driven unit 20 for driving the compression unit 30 comprises a stator 21 fixed to the case 10, a rotor 22 rotating by means of electromagnetic reciprocating operation relative to the stator 21, and a crank shaft 23 press-fit in the rotor 22 and having an eccentric portion 23*a*. The eccentric portion 23*a* is connected to the connecting rod 40.

As shown in FIG. 2, a protruding discharge muffler 72 is provided at the bottom of the cylinder block 70. The discharge muffler 72 is connected with a refrigerant discharge pipe 74, which is connected to a condenser (not shown) and the discharge muffler 72 is sealed by a muffler cover 73. In addition, the discharge muffler 72 is connected to a refrigerant path 75 formed through the cylinder block 70. The refrigerant in the refrigerant discharge chamber 62 flows into the discharge muffler 72 through the refrigerant path 75.

In the above-described conventional compressor, as shown in FIGS. 1 and 2, the refrigerant flows into the compression chamber 71 sequentially through a refrigerant suction pipe 91, a muffler 90, and into the refrigerant suction chamber 61, and is discharged into the refrigerant discharge chamber 62 after being compressed by linear reciprocation of the piston 50. The refrigerant discharged into the refrigerant discharge chamber 62 flows into the discharge muffler 72 through the refrigerant path 75 and then into the condenser through the refrigerant discharge pipe 74.

However, in such a conventional reciprocating compressor, discharge pulsation occurs because the piston 50 in the compression chamber 71 sucks in, compresses, and discharges the refrigerant while linearly reciprocating. Such discharge pulsation of the refrigerant causes noise and vibration in the compressor. Particularly, since the vibration of the compressor occurs at the acoustic low frequency band corresponding to the natural or resonant frequency of other parts of the refrigerator, this creates resonance with other parts of the refrigerator. This resonance causes noise and vibration to increase in the overall refrigerator during operation.

The discharge pulsation of the refrigerant may be reduced by increasing the flow resistance of the discharge refrigerant. That is, the discharge pulsation of the refrigerant may be reduced by reducing the sectional area of the refrigerant path 75 between the refrigerant discharge chamber 62 and the discharge muffler 72, or lengthening the refrigerant path 75, either of which causes an increase in flow resistance. However, when the sectional area of the refrigerant path 75 is too small, the refrigerant cannot flow smoothly between the refrigerant discharge chamber 62 and the discharge muffler 72, and therefore the compression efficiency of the compressor drops. In addition, the refrigerant cannot be sufficiently lengthened as it is formed through the cylinder block 70.

SUMMARY OF THE INVENTION

In order to solve the above-mentioned problem, the present invention has been developed to provide a reciprocating compressor capable of efficiently reducing the discharge pulsation by improving the refrigerant discharge structure.

In order to achieve the object of the present invention, the reciprocating compressor comprises a main frame disposed inside a case to support an electrically-driven unit, a cylinder block connected with the main frame and having a compression chamber, a cylinder head having a refrigerant discharge chamber and connected with the cylinder block to seal the compression chamber, a first chamber formed at one side of the cylinder block to be connected with the refrigerant discharge chamber, a second chamber connected with a refrigerant discharge pipe and formed at another side of the cylinder block, and a gasket disposed between the main frame and the cylinder block, the gasket having a groove for providing a connecting path connecting the first chamber and the second chamber and thus fluid communication between the chambers.

Accordingly, discharge pulsation is reduced as the compressed refrigerant flows through the first chamber, the connecting path, and the second chamber before being discharged through the refrigerant discharge pipe.

In the above-described structure, it is preferable that a first oil chamber corresponding to the first chamber is disposed at one side of the main frame adjacent the first chamber, and a second oil chamber corresponding to the second chamber is disposed at another side of the main frame.

In addition, it is preferable that the first and the second chambers have a height of between about 14 mm and 30 mm and a volume of between about 15 and 25 cc.

The connecting path has a cross sectional area of between about 2.5 and 10 $mm^2$.

It is preferable that the first and second oil chambers have a volume of between about 8 and 10 cc.

It is preferable that an insertion hole is formed at one side of the second chamber, and the refrigerant discharge pipe is connected with the refrigerant discharge tube inserted in the insertion hole.

BRIEF DESCRIPTION OF THE DRAWINGS

The aforementioned object and characteristic of the present invention will be made more apparent by describing a preferred embodiment of the present invention with reference to the accompanying drawings, in which.

DETAILED DESCRIPTION OF THE PREFERRED EMBODIMENT

Hereinafter, a preferred embodiment of the present invention will be described in greater detail with reference to the accompanying drawings. In the description, the parts having the same structure and operation as that of the prior art will be given the same reference numbers.

Figure 3:
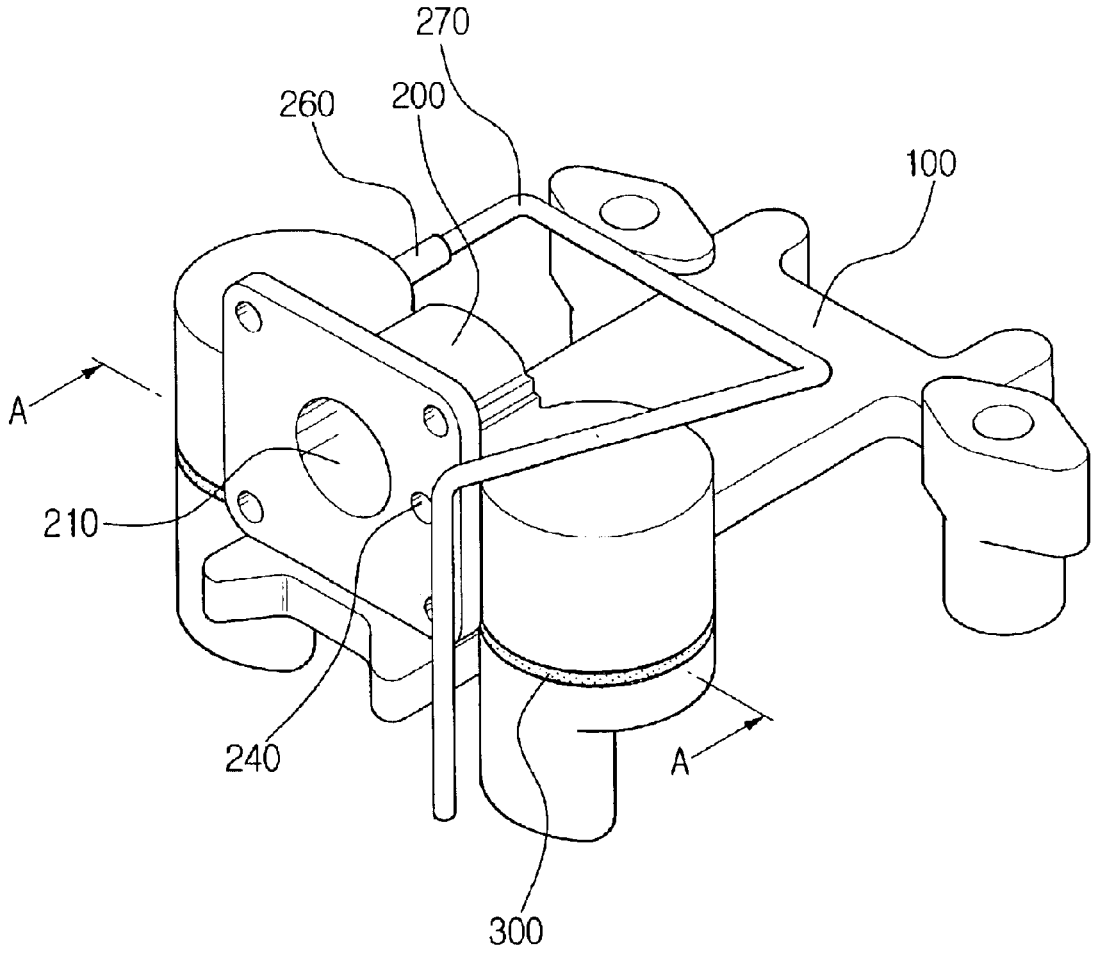
FIG. 3 is a perspective view showing a principal part of the reciprocating compressor according to the preferred embodiment of the present invention.
Figure 4:
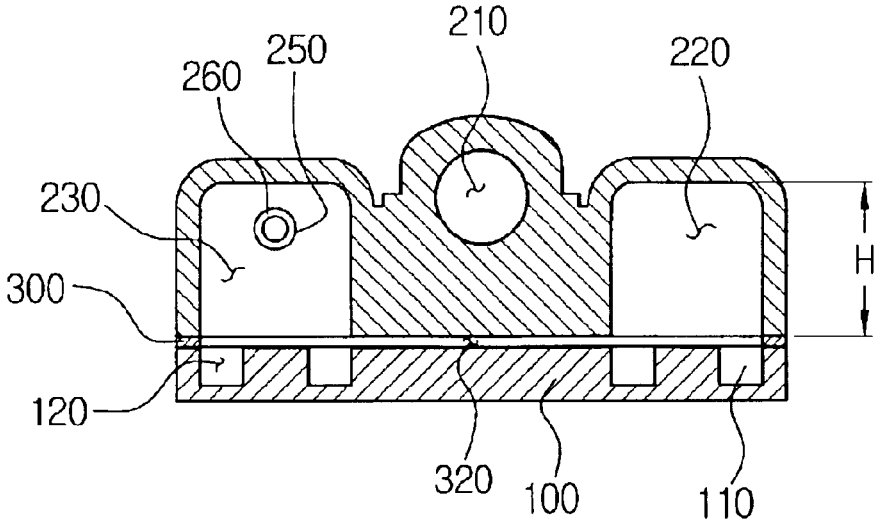
FIG. 4 is a cross-sectional view cut approximately along line A—A of the compressor shown in FIG. 3.

As shown in FIGS. 3 and 4, the reciprocating compressor according to the present invention comprises a main frame 100, a cylinder block 200, first and second chambers 220, 230 and a gasket 300.

Figure 1:
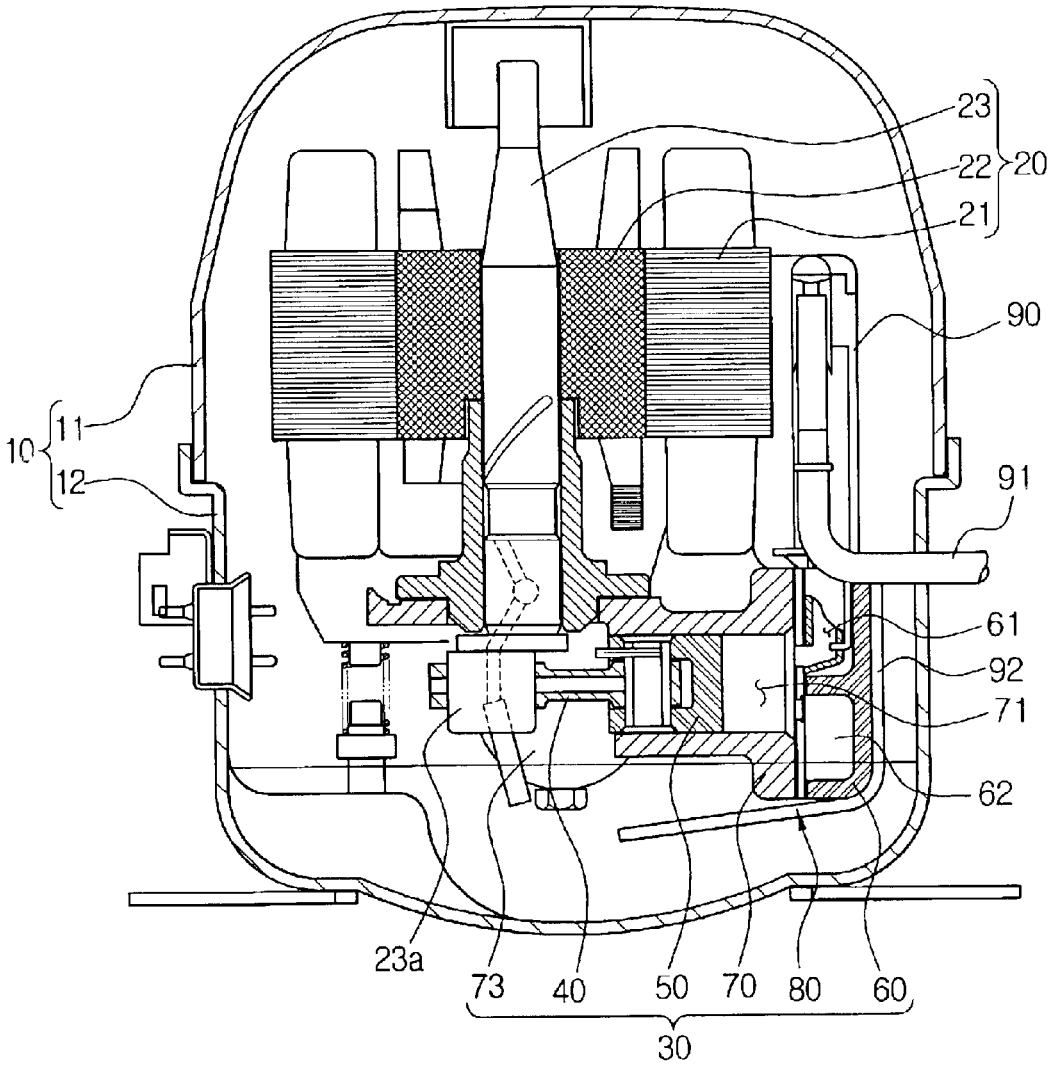
FIG. 1 (PRIOR ART)
FIG. 1 is a sectional view showing the structure of a conventional reciprocating compressor.
Figure 2:
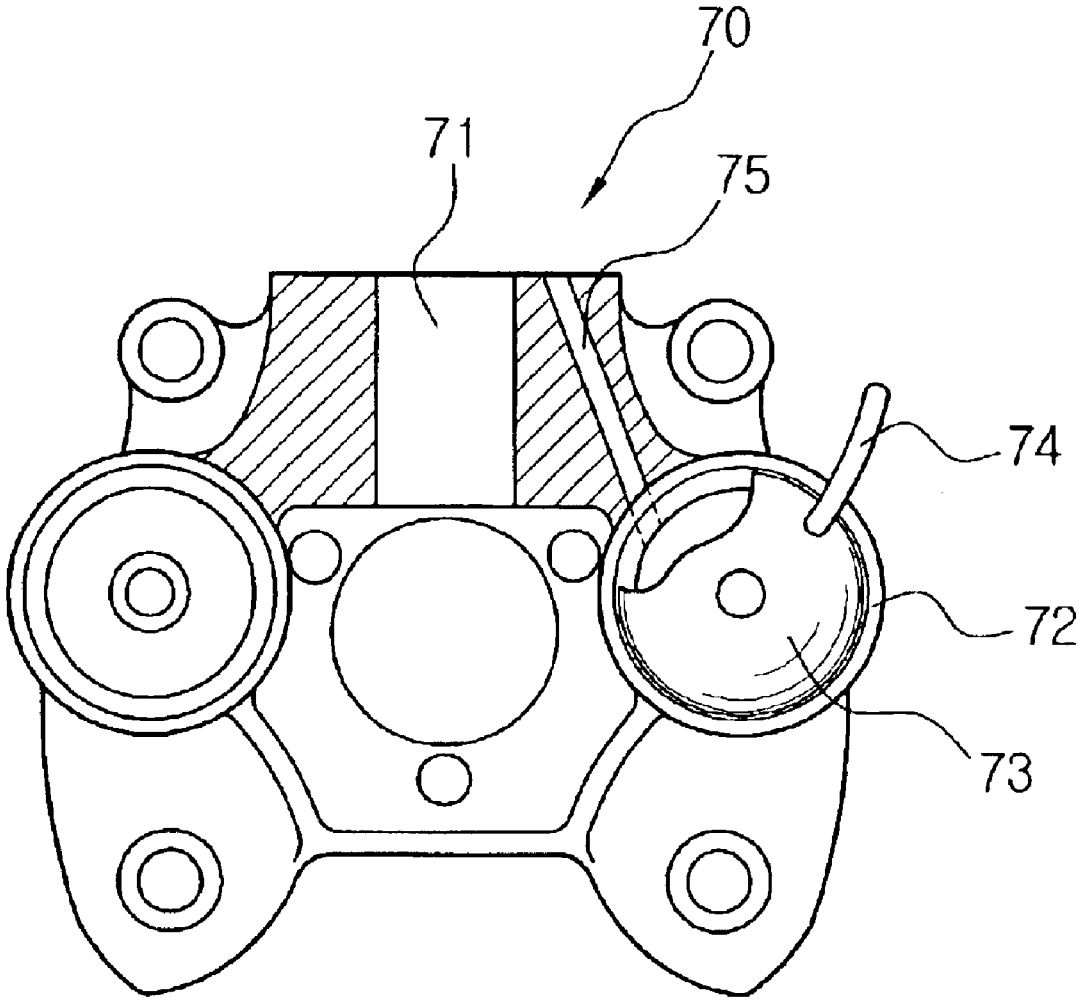
FIG.2 (PRIOR ART)
FIG. 2 is a bottom, partially cutaway view of the reciprocating compressor of FIG. 1.

The main frame 100 is disposed inside the case 10 (FIG. 1) for supporting the electrically-driven unit 20 (FIG. 1). At two sides of the main frame 100, first and second oil chambers 110, 120 are disposed. It is preferable that these oil chambers 110, 120 have a volume between about 8 and 10 cc.

The cylinder block 200 includes a compression chamber 210 and is connected to the top surface of the main frame 100 by a fastening means such as a screw (not shown). At one side of the cylinder block 200 (FIG. 4), a cylinder head 60 (FIG. 1) is connected for sealing the compression chamber 210. The structure and the operation of the cylinder head 60 is the same as that of the prior art device, and will therefore not be discussed in detail here. First and second chambers 220, 230 are provided at both sides of the cylinder block 200, as shown.

The first chamber 220 is formed at one side of the cylinder block 200 to correspond with the first oil chamber 110 of the main frame 100. The first chamber 220 is in fluid communication with the refrigerant discharge chamber 62 (as shown in FIG. 1) of the cylinder head 60 through the refrigerant path 240 (FIG. 3) extending through one side of the cylinder block 200. The first chamber 220 is configured to have an appropriate height and volume for reducing the discharge pulsation that occurs as a result of the flow of the refrigerant. It is preferable that the height is between about 14 and 30 mm, and the volume is between 15 and 25 cc.

The second chamber 230 is formed at the other side of the cylinder block 200 to correspond with the second oil chamber 120 of the main frame 100. At one side of the second chamber 230, an insertion hole 250 is formed, and a discharge tube 260 connected with the refrigerant discharge pipe 270 is press fit in the insertion hole. The second chamber 230 is configured to have an appropriate height and volume for reducing the discharge pulsation that occurs because of the flow of the refrigerant. It is preferable that the height is between about 14 and 30 mm, and the volume is between about 15 and 25 cc, similar to those dimensions of the first chamber 220.

Figure 5:
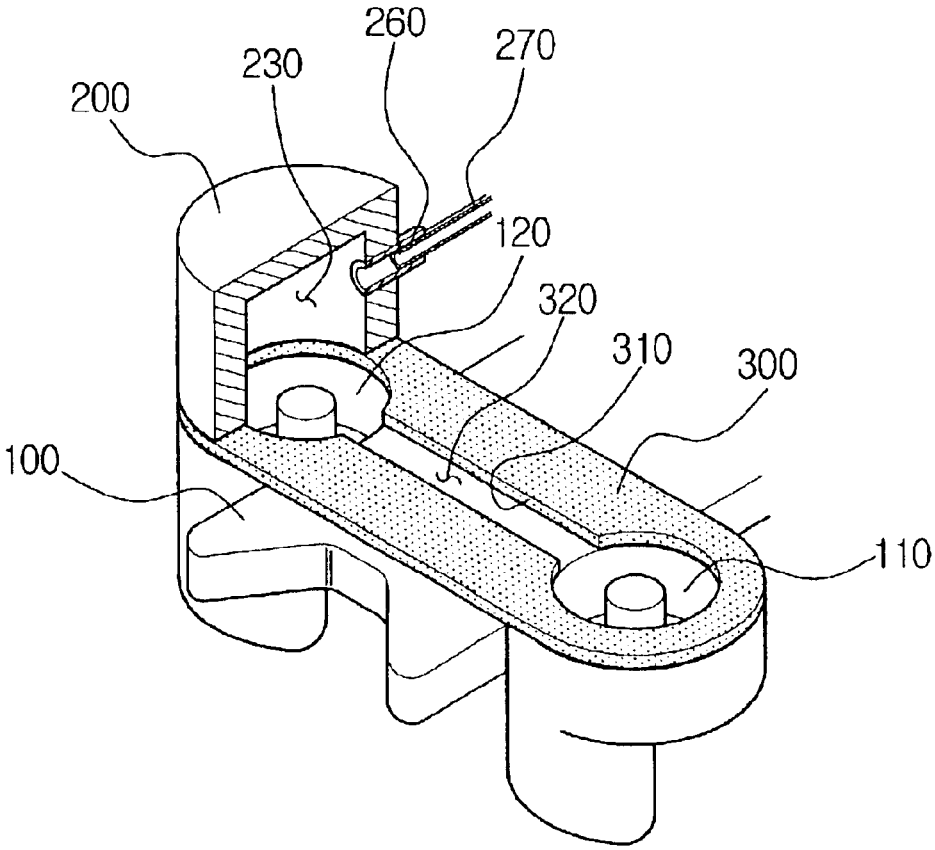
FIG. 5 is a partially cut-away, perspective view of the compressor shown in FIG. 3.

A gasket 300 seals the gap between the main frame 100 and the cylinder block 200 by being disposed between those two parts. The gasket 300 has a groove 310 (FIG. 5) and the groove 310 forms a connecting path 320 connecting the first chamber 220 and the second chamber 230. Accordingly, the refrigerant in the first chamber 220 flows to the second chamber 230 through the connecting path 320. It is preferable that the connecting path 320 has a cross-sectional area of appropriate dimensions, for example, between about 2.5 and 10 $mm^2$. Accordingly, the groove 310 is formed having a width corresponding to the desired cross-sectional area of the connecting path 320.

Hereinafter, the operation of the reciprocating compressor having the above structure is described.

When the piston 50 (FIG. 1) retrogrades toward the bottom dead point inside the compression chamber 210 by the rotation of the crank shaft 23 (FIG. 1), the low pressure refrigerant flows into the suction muffler 90 (FIG. 1) through the suction pipe 91 (FIG. 1) and thereafter flows into the compression chamber 210 (FIG. 3) through the refrigerant suction chamber 61 of the cylinder head 60 together with the oil supplied by an oil supply pipe 92 (FIG. 1). After that, when the piston 50 moves toward the top dead point inside the compression chamber 210 as the crank shaft 23 further rotates, the refrigerant is compressed to a high pressure. The compressed refrigerant is temporarily stored in the refrigerant discharge chamber 62 of the cylinder head 60 and then flows into the first chamber 220 through the refrigerant path 240 (FIG. 3) of the cylinder block 200. The oil included in the refrigerant is separated in the first oil chamber 110 (FIG. 4) and the refrigerant separated from the oil flows into the second chamber 230 through the connecting path 320. The oil remaining in the refrigerant is separated from the refrigerant in the second oil chamber 120. The refrigerant separated from the oil flows in to the condenser through the discharge tube 260 and the refrigerant discharge pipe 270.

In the process of discharging the refrigerant, the compressed refrigerant flows sequentially through the refrigerant discharge chamber 62 of the cylinder head 60 to the first chamber 220, the connecting path 320, and the second chamber 230, and thus the discharge pulsation is reduced.

The present invention has an effect of reducing the noise and vibration of the compressor and the refrigerating machines as the first chamber, the connecting path, and the second chamber all provide a fluid communication path of a predetermined size provided between the refrigerant discharge chamber and the refrigerant discharge pipe for reducing the discharge pulsation of the refrigerant.

In addition, the present invention also has an effect of improving the compression efficiency of the refrigerant, since the oil included in the refrigerant is separated while passing through the first and the second chambers.

Moreover, manufacturing costs can be reduced because the main frame and the cylinder block are produced separately as parts having a simple shape and are thereafter more easily assembled.

Although the preferred embodiments of the present invention have been described, it will be understood by those skilled in the art that the present invention should not be limited to the described preferred embodiments. Various changes and modifications can be made while remaining within the sprit and scope of the present invention as defined by the appended claims.

What is claimed is:

1. A reciprocating compressor comprising:

a main frame disposed inside a case to support an electrically-driven unit;

a cylinder block connected with the main frame and having a compression chamber;

a cylinder head having a refrigerant discharge chamber and connected with the cylinder block to seal the compression chamber;

a first chamber formed at one side of the cylinder block to be connected with the refrigerant discharge chamber;

a second chamber connected with a refrigerant discharge pipe and formed at another side of the cylinder block;

a gasket disposed between the main frame and the cylinder block, the gasket having a groove for providing a connecting path connecting the first chamber and the second chamber; and a first oil chamber corresponding to the first chamber formed at the side of the main frame adjacent the first chamber.

2. The reciprocating compressor in claim 1, wherein a second oil chamber corresponding to the second chamber is formed at another side of the main frame adjacent the second chamber.

3. The reciprocating compressor in claim 2, wherein the first and the second chambers have a height of between about 14 mm and 30 mm.

4. The reciprocating compressor in claim 2, wherein the first and the second chambers have a volume of between about 15 and 25 cc.

5. The reciprocating compressor in claim 2, wherein the connecting path has a cross sectional area of between about 2.5 and 10 $mm^2$.

6. The reciprocating compressor in claim 2, wherein the first and second oil chambers have a volume of between about 8 and 10 cc.

7. The reciprocating compressor in claim 2, wherein the first and the second chambers have a height of between about 14 mm and 30 mm and a volume of between about 15 and 25 cc;

the connecting path has a cross sectional area of between about 2.5 and 10 $mm^2$; and the first and second oil chambers have a volume of between about 8 and 10 cc.

8. The reciprocating compressor in claim 7, wherein an insertion hole is formed at one side of the second chamber, and the refrigerant discharge pipe is connected with the refrigerant discharge tube inserted in the insertion hole.

* * * * *